US006966306B2

(12) United States Patent
Sawert et al.

(10) Patent No.: US 6,966,306 B2
(45) Date of Patent: Nov. 22, 2005

(54) FUEL PUMP MODULE ASSEMBLY FOR FUEL TANK

(75) Inventors: Ulf Sawert, Grand Blanc, MI (US); William S. Zimmerman, Grand Blanc, MI (US); David H. Burke, Flint, MI (US); Joanne F. Tersigni, Vassar, MI (US); Rick E. Crandall, Fenton, MI (US); Robert A. Roth, Grand Blanc, MI (US); Susan P. Tyndall, Fenton, MI (US); Nicholas D. Tenbrink, Goodrich, MI (US)

(73) Assignee: Delphi Technologies, Inc., Troy, MI (US)

( * ) Notice: Subject to any disclaimer, the term of this patent is extended or adjusted under 35 U.S.C. 154(b) by 52 days.

(21) Appl. No.: 10/729,051

(22) Filed: Dec. 5, 2003

(65) Prior Publication Data

US 2005/0121003 A1 Jun. 9, 2005

(51) Int. Cl.[7] ..... F02M 37/04
(52) U.S. Cl. ..... 123/509
(58) Field of Search ..... 123/509, 510, 123/511, 457, 459

(56) References Cited

U.S. PATENT DOCUMENTS

| | | | | |
|---|---|---|---|---|
| 5,613,476 | A * | 3/1997 | Oi et al. | 123/509 |
| 5,782,223 | A * | 7/1998 | Yamashita et al. | 123/510 |
| 6,502,558 | B1 * | 1/2003 | Brunel | 123/509 |
| 6,712,590 | B1 * | 3/2004 | Villela et al. | 417/423.9 |

FOREIGN PATENT DOCUMENTS

FR WO9961777 * 12/1999

* cited by examiner

*Primary Examiner*—Mahmoud Gimie
(74) *Attorney, Agent, or Firm*—Jimmy L. Funke

(57) ABSTRACT

A fuel pump module assembly for a fuel tank in a vehicle includes a reservoir adapted to be disposed in the fuel tank. The fuel pump module assembly also includes a fuel pump disposed in the reservoir to pump fuel from the fuel tank to an engine of the vehicle. The fuel pump module assembly includes a filter disposed in the reservoir and having an inlet fluidly connected to the fuel pump and having a first outlet fluidly connected to the engine and a second outlet. The fuel pump module assembly further includes a regulating valve disposed in the reservoir and fluidly connected to the second outlet to control fuel supply pressure to the engine.

18 Claims, 1 Drawing Sheet

FUEL PUMP MODULE ASSEMBLY FOR FUEL TANK

TECHNICAL FIELD

The present invention relates generally to fuel tanks for vehicles and, more particularly, to a fuel pump module assembly for a fuel tank of a vehicle.

BACKGROUND OF THE INVENTION

It is known to provide a fuel tank for a vehicle to hold fuel to be used by an engine of the vehicle. In some vehicles, the fuel tank includes a fuel pump module disposed therein with a removable cover sealed to the top of the fuel tank having an electrical connector and a fuel line outlet connector. The fuel pump module generally includes a fuel reservoir, an electrical fuel pump disposed in the reservoir, and a secondary or jet pump used to fill the reservoir to overfilling.

An example of a fuel pump module or fuel sender is disclosed in U.S. Pat. No. 5,647,330 to Sawert et al. In this patent, the fuel pump module or fuel sender includes a fuel pump disposed in a reservoir with pressure relief and check valves. Moreover, fuel senders typically contain a separate jet pump and fuel regulator. The fuel regulator is sometimes located on a fuel rail and not in the fuel sender or fuel pump module. The jet pump is supplied using hot engine return fuel back to the reservoir, high pressure feed fuel from the fuel pump, or regulator by-pass fuel. Typically, the regulator requires a highly performing seal to prevent fuel leak down and can withstand some amount of back pressure. Moreover, jet pump plumbing typically involves fittings and tubing.

Therefore, it is desirable to provide a new fuel pump module for a fuel tank in a vehicle. It is also desirable to provide a fuel pump module that eliminates the use of multiple check and relief valves. It is further desirable to provide a fuel pump module having a regulator and jet pump that reduces connections and assembly therebetween. Thus, there is a need in the art to provide a fuel pump module that meets these desires.

SUMMARY OF THE INVENTION

Accordingly, the present invention is a fuel pump module assembly for a fuel tank in a vehicle including a reservoir adapted to be disposed in the fuel tank. The fuel pump module assembly also includes a fuel pump disposed in the reservoir to pump fuel from the fuel tank to an engine of the vehicle. The fuel pump module assembly includes a fuel filter disposed in the reservoir and having an inlet fluidly connected to the fuel pump and having a first outlet fluidly connected to the engine and a second outlet. The fuel pump module assembly further includes a regulating valve disposed in the reservoir and fluidly connected to the second outlet to control fuel supply pressure to the engine.

One advantage of the present invention is that a fuel pump module assembly is provided for a fuel tank that precludes the use of multiple check and relief valves by allowing for the elimination of these valves from a fuel pump. Another advantage of the present invention is that the fuel pump module assembly provides a single relief/check valve in a cover thereof. Yet another advantage of the present invention is that the fuel pump module assembly has a flow biased relief or regulating valve located in a reservoir, thereby retaining by-pass fuel within the reservoir. Still another advantage of the present invention is that the fuel pump module assembly, by having a highly performing check valve above a filter, sealing requirements for a flow biased relief valve (pressure regulator) are reduced. A further advantage of the present invention is that the fuel pump module assembly, by providing access to high-pressure fuel for a jet pump, provides a consistent supply of fuel for the jet pump, thereby eliminating variability in fill characteristics of jet pumps operated with by-pass fuel. Yet a further advantage of the present invention is that the fuel pump module assembly prevents back pressure on a flow biased relief valve, which may negatively affect its pressure regulating ability. Still a further advantage of the present invention is that the fuel pump module assembly allows for packaging of a flow biased relief or regulating valve and jet pump together, thereby reducing connections and assembly.

Other features and advantages of the present invention will be readily appreciated, as the same becomes better understood, after reading the subsequent description taken in conjunction with the accompanying drawings.

BRIEF DESCRIPTION OF THE DRAWINGS

The FIGURE is a fragmentary elevational view of a fuel pump module assembly, according to the present invention, illustrated in operational relationship with a fuel tank of a vehicle.

DESCRIPTION OF THE PREFERRED EMBODIMENT

Figure 1:
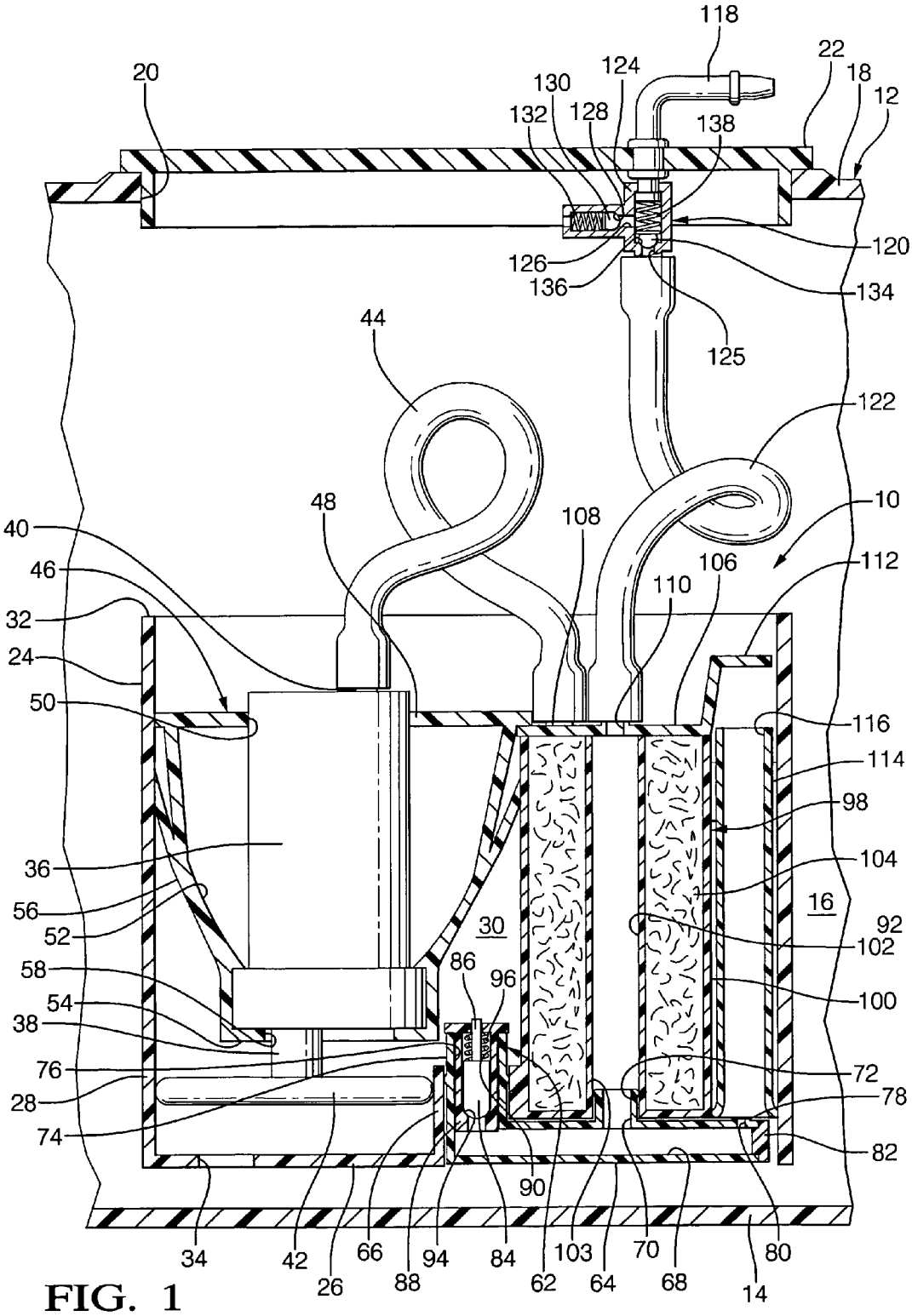

Referring to the drawing, one embodiment of a fuel pump module assembly 10, according to the present invention, is shown for a fuel tank, generally indicated at 12, of a vehicle (not shown). In this embodiment, the fuel tank 12 has a bottom wall 14, a side wall 16 around a periphery of the bottom wall 14 and extending generally perpendicular thereto, and a top wall 18 around a periphery of the side wall 16 and extending generally perpendicular thereto. The fuel tank 12 is made of a rigid material such as plastic. The top wall 18 includes at least one opening 20 for a fuel tank cover 22. It should be appreciated that the cover 22 has insert molded terminals (not shown) and integral guide rods (not shown). It should also be appreciated that, except for the fuel pump module assembly 10, the fuel tank 12 is conventional and known in the art.

The fuel pump module assembly 10 includes a fuel reservoir 24 disposed inside the fuel tank 12 to hold fuel. The fuel reservoir 24 has a bottom portion 26 and an annular side portion 28 extending generally perpendicularly from the bottom portion 26 to form a chamber 30. The fuel reservoir 24 is generally bucket-shaped and open at a top end 32 thereof, which defines an overflow fuel level in the fuel reservoir 24. The fuel reservoir 24 also has an inlet 34 formed in the bottom portion 26. It should be appreciated that the top end 32 is, some of the time, above the highest level of bulk fuel in the fuel tank 12 so that, at times, there is little or no in-and-out flow over the top. It should also be appreciated that the top end 32 may be partially closed to minimize splash-over while still venting the interior of the fuel reservoir 24.

The fuel pump module assembly 10 also includes a fuel pump 36 disposed in the fuel reservoir 24. The fuel pump 36 is of a high-pressure electric fuel pump type. The fuel pump 36 extends axially and is generally cylindrical and circular in cross-sectional shape. The fuel pump 36 has an inlet 38 at a lower axial end and an outlet 40 at an upper axial end. It should be appreciated that the fuel pump 36 is conventional and known in the art.

The fuel pump module assembly 10 includes a fuel strainer 42 connected to the inlet 38 of the fuel pump 36. The outlet 40 of the fuel pump 36 is connected by a conduit or hose 44 to a fuel filter assembly 98 to be described, which is, in turn, fluidly connected to the cover 22 to communicate fuel to an engine (not shown) of the vehicle. It should be appreciated that the fuel pump 36 is also connected by wires (not shown) to a source of electrical power such as a controller (not shown). It should also be appreciated that the fuel strainer 42 is conventional and known in the art. It should further be appreciated that the fuel pump 36 does not have relief and check valves.

The fuel pump module assembly 10 includes a fuel pump retainer, generally indicated at 46, disposed in the fuel reservoir 24 to support the fuel pump 36 therein. The fuel pump retainer 46 includes a base wall 48 extending radially and engaging the side portion 28 of the fuel reservoir 24. The base wall 48 has an aperture 50 extending therethrough. The fuel pump retainer 46 also includes an annular retainer wall 52 extending axially from the base wall 48 and about the aperture 50. The fuel pump retainer 46 includes an annular flange wall 54 extending generally perpendicularly from the retainer wall 52. The base wall 48, retainer wall 52, and flange wall 54 form a pump cavity 56. The flange wall 54 also has an aperture 58 extending therethrough. The fuel pump retainer 46 includes an annular support wall 60 interconnecting the base wall 48 and the retainer wall 52. The fuel pump 36 extends through the aperture 50 and is disposed in the pump cavity 56 with the inlet 38 of the fuel pump 36 extending through the aperture 58. The fuel pump retainer 46 is made of a plastic material. The fuel pump retainer 46 may be a monolithic structure being integral, unitary, and one-piece. It should be appreciated that the retainer wall 52 flexes to retain the fuel pump 36. It should also be appreciated that the fuel pump retainer 46 may be connected to the fuel reservoir 24 by suitable means such as welding.

The fuel pump module assembly 10 also includes a jet pump and regulating valve assembly, generally indicated at 62, adjacent the bottom portion 26 of the fuel reservoir 24. The jet pump and regulating valve assembly 62 includes a jet pump body 64 disposed between a wall 66 extending upwardly from the bottom portion 26 and the side portion 28 of the fuel reservoir 24. The jet pump body 64 is a generally hollow member having a cavity 68 and a first tubular portion 70 centrally disposed and extending upwardly with an opening 72 that communicates with the cavity 68 to form a clean fuel return. The jet pump body 64 also has a second tubular portion 74 at one axial end extending upwardly with an opening 76 that communicates with the cavity 68 to form a mount for a regulating valve 84 to be described. The jet pump body 64 also has a third tubular portion 78 at the other axial end extending upwardly with an opening 80 that communicates with the cavity 68 to form a jet pump orifice. The jet pump body 64 has a plug member 82 closing the axial end of the cavity 68 adjacent the opening 80 forming the jet pump orifice. The jet pump body 64 is made of a plastic material. The jet pump body 64 may be integral and formed as one-piece with the fuel reservoir 24.

The jet pump and regulating valve assembly 62 also includes a flow biased control or regulating valve 84 disposed in the second tubular portion 74 to control the pressure of the fuel provided to the engine. The regulating valve 84 is generally cylindrical in shape and has a generally circular cross-sectional shape. The regulating valve 84 has a projection 86 extending upwardly to guide the movement thereof. The jet pump and regulating valve assembly 62 also includes a valve body 88 closing the opening 76 and disposed in the second tubular portion 74. The valve body 88 is generally tubular in shape and has a passageway 90 extending axially therein. The valve body 88 has an aperture 92 extending through one axial end communicating with the passageway 90 and to guide the projection 86 extending therethrough. The valve body 88 has a valve seat 94 near the other axial end of the passageway 90. The regulating valve 84 is disposed in the passageway 90 and cooperates with the valve seat 94. The jet pump and regulating valve assembly 62 further includes a spring 96 such as a coil spring disposed in the passageway 90 between the regulating valve 84 and the end of the valve body 88 to urge the regulating valve 84 toward the valve seat 94. It should be appreciated that the aperture 92 allows fuel to be discharged into the chamber 30 of the fuel reservoir 24.

The fuel pump module assembly 10 includes a filter assembly, generally indicated at 98, disposed in the fuel reservoir 24. The filter assembly 98 includes a filter shell or body 100 having a generally cylindrical shape and circular cross-sectional shape. The filter body 100 has a passageway 102 extending axially therethrough. The lower end of the passageway 102 forms an outlet 103. The filter body 100 is disposed in the fuel reservoir 24 and the first tubular portion 70 of the jet pump body 64 extends into a lower end of the passageway 102 to support the filter body 100. The filter body 100 is made of a plastic material. It should be appreciated that the filter body 100 may be molded as part of the fuel reservoir 24.

The filter assembly 98 also includes a filter element 104 disposed within the filter body 100. The filter element 104 is of a pleated paper material to filter contaminants in the fuel. It should be appreciated that the filter element 104 is conventional and known in the art.

The filter assembly 98 further includes a filter endcap 106 connected to an upper axial end of the filter body 100. The filter endcap 106 extends radially and is generally circular in shape. The filter endcap 106 has an inlet 108 connected to the hose 44 to receive high pressure fuel fed from the fuel pump 36. The filter endcap 106 also has an outlet 110 spaced radially from the inlet 108 to provide fuel to the engine. The filter endcap 106 may include a splash member 112 extending upwardly and radially therefrom for a function to be described. The filter endcap 106 is made of a plastic material. The filter endcap 106 is a monolithic structure being integral, unitary, and one-piece. It should be appreciated that the filter endcap 106 may be fixedly attached to the fuel reservoir 24 by suitable means such as welding. It should also be appreciated that the filter endcap 106 interfaces with the filter element 104 such that fuel entering the inlet 108 must pass through the filter element 104 before getting to the outlet 110.

The fuel pump module assembly 10 also includes a jet pump barrel member 114 extending upwardly from the jet pump body 64 and into the chamber 30 of the fuel reservoir 24. The jet pump barrel member 114 is tubular and has a generally circular cross-sectional shape. The jet pump barrel member 114 has a passageway 116 extending therethrough. The jet pump barrel member 114 is disposed adjacent the filter body 100 and has a lower end disposed over the third tubular portion 78 and an upper portion disposed under the splash member 112 to minimize splash-over while still venting the interior of the fuel reservoir 24. The jet pump barrel member 114 may be integral and formed as one-piece with either the filter body 100 or the fuel reservoir 24. It should be appreciated that the jet pump barrel member 114 extends into the chamber 30 of the fuel reservoir 24. It should also be appreciated that the fuel reservoir 24 holds fuel around the jet pump orifice and is filled by fuel coming out of the jet pump barrel member 114.

The fuel pump module assembly 10 includes a fuel connector 118 connected to the cover 22. The fuel connector 118 is tubular in shape with a generally circular cross-section. The fuel pump module assembly 10 also includes a combination check and relief valve assembly, generally indicated at 120, disposed within the fuel tank 12 and connected to the fuel connector 118 to prevent fuel from draining out of the fuel line when the engine is shut off. The fuel pump module assembly 10 further includes a conduit or hose 122 connected to the valve assembly 120 and to the inlet 110 of the filter endcap 106 to allow fuel flow therebetween.

The valve assembly 120 includes a valve body 124 having a generally "T" shape. The valve body 124 has a first passageway 125 extending axially therethrough and a second passageway 126 extending radially and communicating with the first passageway 125. The valve body 124 has a valve seat 128 near the end of the second passageway 126. The valve assembly 120 includes a relief valve member 130 disposed in the second passageway 126 and cooperating with the valve seat 128. The valve assembly 120 further includes a spring 132 such as a coil spring disposed in the second passageway 126 between the relief valve member 130 and the end of the valve body 124 to urge the relief valve member 130 toward the valve seat 128. It should be appreciated that the relief valve member 130 of the valve assembly 120 allows fuel from the engine to be discharged into the fuel tank 12 when the fuel pressure in the fuel line rises while the jet pump and fuel regulating assembly 62 is not operating.

The valve assembly 120 includes a check valve member 134 disposed in the first passageway 125 and a valve seat 136 near the end of the first passageway 125 cooperating with the check valve member 134. The valve assembly 120 further includes a spring 138 such as a coil spring disposed in the first passageway 125 between the check valve member 134 and the end of the valve body 124 to urge the check valve member 134 toward the valve seat 136. It should be appreciated that the check valve member 134 of the valve assembly 120 allows one-way fuel flow from the filter assembly 98 to the engine. It should also be appreciated that the relief valve member 130 is disposed above the check valve member 134 of the valve assembly 120.

In operation, the fuel pump module assembly 10 is illustrated in an assembled state in which fuel (not shown) is disposed in the fuel tank 12. In a mode of operation, fuel is strained by the strainer 42 and the fuel pump 36 pumps high pressure fuel via the hose 44 to the filter assembly 98. Fuel flows through the filter element 102 and then out through the outlet 110 via the hose 122 to the valve assembly 120. Fuel flows past the check valve member 134 and through the inlet connector 118 to the engine. Fuel excess to the engine's requirement flows through the filter element 104 and passageway 102 and outlet 103 to the opening 72 of the jet pump body 64. Some of the fuel flows through the opening 72 of the jet pump body 64 to the chamber 68 therein and exits the third aperture 80 into the jet pump barrel member 114. Fuel flows through the jet pump barrel member 114 and into the chamber 30 of the fuel reservoir 24 to fill the fuel reservoir 24. The rest of the fuel from the opening 72 flows to the passageway 90 and to the regulating valve 84 to the chamber 30 of the fuel reservoir 24 to control the pressure of the fuel provided to the engine. When the fuel pressure in the fuel line rises while the jet pump and fuel regulating assembly 62 is not operating, the fuel from the engine flows past the relief valve member 130 of the valve assembly 120 and is discharged into the fuel tank 12.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump module assembly for a fuel tank in a vehicle comprising:

a reservoir adapted to be disposed in the fuel tank;

a fuel pump disposed in said reservoir to pump fuel from the fuel tank to an engine of the vehicle;

a fuel filter disposed in said reservoir and having an inlet fluidly connected to said fuel pump and having a first outlet fluidly connected to the engine and a second outlet;

a jet pump body coupled to said second outlet and having a jet pump orifice; and a regulating valve assembly coupled to the jet pump body apart from said jet pump orifice for discharging fuel to said reservoir, whereby the regulating valve controls fuel supply pressure to the engine.

2. A fuel pump module assembly as set forth in claim 1 including a cover adapted to close an opening in the fuel tank.

3. A fuel pump module assembly as set forth in claim 2 including a check and relief valve assembly disposed above said reservoir and operatively connected to said cover.

4. A fuel pump module assembly as set forth in claim 3 wherein said check and relief valve assembly comprises a valve housing having a generally "T" shape.

5. A fuel pump module assembly as set forth in claim 4 wherein said check and relief valve assembly comprises a check valve disposed in said valve housing for allowing one-way flow of fuel from said fuel filter to the engine.

6. A fuel pump module assembly as set forth in claim 5 wherein said check and relief valve assembly comprises a relief valve disposed in said valve housing above said check valve for allowing one-way flow of fuel from the engine into the fuel tank.

7. A fuel pump module assembly as set forth in claim 1 including a jet pump barrel extending into a chamber of said reservoir and cooperating with an outlet of said jet pump.

8. A fuel pump module assembly as set forth in claim 1 wherein said regulating valve assembly comprises a valve housing having a passageway with a valve seat, a movable regulating valve disposed in said passageway, and a spring disposed in said passageway to urge said regulating valve toward said valve seat.

9. A fuel pump module assembly as set forth in claim 1 including a pump retainer disposed in a chamber of said reservoir to support said fuel pump therein.

10. A fuel pump module assembly for a fuel tank in a vehicle comprising:

a reservoir adapted to be disposed in the fuel tank and having a chamber therein;

a cover adapted to close an opening in the fuel tank;

a fuel pump disposed in said reservoir to pump fuel from the fuel tank to an engine of the vehicle;

a fuel filter disposed in said reservoir and having an inlet, a first outlet, and a second outlet;

a first conduit interconnecting said fuel pump and said inlet of said fuel filter;

a second conduit operatively interconnecting said first outlet of said fuel filter and said cover;

a jet pump disposed in said reservoir and fluidly connected to said second outlet, said jet pump comprising a jet pump orifice for discharging fuel to said reservoir; and a regulating valve disposed in said reservoir and connected to said jet pump and fluid connected to said second outlet apart from said jet pump orifice to discharge by-pass fuel to said reservoir and thereby control fuel supply pressure.

11. A fuel pump module assembly as set forth in claim 10 including a check and relief valve assembly disposed above said reservoir and operatively connected to said cover.

12. A fuel pump module assembly as set forth in claim 11 wherein said check and relief valve assembly comprises a valve housing having a generally "T" shape.

13. A fuel pump module assembly as set forth in claim 12 wherein said check and relief valve assembly comprises a check valve disposed in said valve housing for allowing one-way flow of fuel from said fuel filter to the engine.

14. A fuel pump module assembly as set forth in claim 13 wherein said check and relief valve assembly comprises a relief valve disposed in said valve housing above said check valve for allowing one-way flow of fuel from the engine into the fuel tank.

15. A fuel pump module assembly as set forth in claim 10 including a jet pump barrel extending into said chamber and cooperating with said outlet.

16. A fuel pump module assembly as set forth in claim 10 wherein said regulating valve comprises a valve housing having a passageway with a valve seat, a movable valve member disposed in said passageway, and a spring disposed in said passageway to urge said valve member toward said valve seat.

17. A fuel pump module assembly as set forth in claim 10 including a pump retainer disposed in said chamber to support said fuel pump therein.

18. A fuel tank assembly for a vehicle comprising:

a fuel tank;

a reservoir adapted to be disposed in the fuel tank and having a chamber therein;

a cover adapted to close an opening in the fuel tank;

a fuel pump disposed in said reservoir to pump fuel from the fuel tank to an engine of the vehicle;

a fuel filter disposed in said reservoir and having an inlet, a first outlet, and a second outlet, said inlet being fluidly connected to said fuel pump;

a jet pump disposed in said reservoir and fluidly connected to said second outlet, said jet pump comprising a jet pump orifice for discharging fuel to said reservoir;

a regulating valve disposed in said reservoir and connected to said jet pump and fluidly connected to said second outlet apart form the jet pump orifice to discharge by-pass fuel to said reservoir and thereby control fuel supply pressure; and a check and relief valve assembly disposed above said reservoir and operatively connected to said cover, said check and relief valve assembly comprising a check valve for allowing one-way flow of fuel from said fuel filter to the engine and a relief valve disposed above said check valve for allowing one-way flow of fuel from the engine into the fuel tank.

* * * * *